United States Patent [19]

Majkrzak

[11] Patent Number: 4,461,249

[45] Date of Patent: Jul. 24, 1984

[54] METHOD AND APPARATUS OF STARTING A COLD ENGINE

[75] Inventor: David S. Majkrzak, West Fargo, N. Dak.

[73] Assignee: Steiger Tractor Inc., Fargo, N. Dak.

[21] Appl. No.: 425,548

[22] Filed: Sep. 28, 1982

[51] Int. Cl.[3] ..... F02N 17/02

[52] U.S. Cl. ..... 123/142.5 E; 123/142.5 R; 123/556; 123/179 H

[58] Field of Search ..... 123/142.5 R, 142.5 E, 123/179 H, 556

[56] References Cited

U.S. PATENT DOCUMENTS

| | | | |
|---|---|---|---|
| 1,185,010 | 5/1916 | Seederly | 219/207 |
| 1,331,061 | 2/1920 | Harding | 219/206 |
| 1,562,240 | 11/1925 | Melozzi | 123/142.5 E |
| 1,863,882 | 6/1932 | Scharf | 123/142.5 E |
| 2,177,840 | 10/1939 | Roualet | 123/142.5 E |
| 2,414,214 | 1/1947 | Spackman | 123/142.5 R |
| 2,610,282 | 9/1952 | Brownell | 219/38 |
| 2,717,305 | 9/1955 | Guthrie | 219/38 |
| 2,906,848 | 9/1959 | Spal | 219/38 |
| 3,373,728 | 3/1968 | Collins | 123/142.5 R |
| 3,394,243 | 7/1968 | Lee | 219/205 |
| 3,397,684 | 8/1968 | Scherenberg | 123/179 |
| 3,400,700 | 9/1968 | Lindsey et al. | 123/142.5 |
| 3,630,183 | 12/1971 | Hoffman | 123/122 |
| 3,809,527 | 5/1974 | Newman | 123/142.5 R |
| 4,020,815 | 5/1977 | Hubert | 123/142.5 |
| 4,047,511 | 9/1977 | Takagi | 123/179 H |
| 4,051,825 | 10/1977 | Elder | 123/142.5 R |
| 4,289,095 | 9/1981 | Scherr | 123/142.5 |
| 4,305,354 | 12/1981 | Majkrzak | 123/142.5 |
| 4,309,967 | 1/1982 | Southard | 123/179 |

*Primary Examiner*—Ira S. Lazarus

*Attorney, Agent, or Firm*—Kinney & Lange

[57] ABSTRACT

A method for heating intake air and a carburetor of a dead, cold internal combustion engine of a first vehicle which uses an apparatus that heats the cold engine with energy supplied by a second vehicle having a running internal combustion engine. The apparatus is placed within the air filter housing above the carburetor of the cold engine. The apparatus includes a housing configured to be positioned within the air filter housing of the cold engine. The apparatus housing includes a source of heat such as a plurality of fin tubes that are fluidly connected to the cooling system of the running engine. The tubes transfer heat from the heated coolant to air surrounding the fin tubes. In a modified form of the invention, electrical heating wires are used to heat the air. The heated air is then mixed with fuel in the carburetor and used to start the cold engine. In a further preferred embodiment, a fan is also included within the apparatus housing for moving air through the heating elements to increase heat transfer efficiency.

11 Claims, 4 Drawing Figures

METHOD AND APPARATUS OF STARTING A COLD ENGINE

BACKGROUND OF THE INVENTION

1. Field of the Invention

The present invention relates to a method and apparatus for heating intake air and a carburetor of a dead, cold internal combustion engine by placing the apparatus within the air filter housing of the cold engine. In particular, the present invention relates to a method and apparatus wherein the energy from a running engine is transferred to an apparatus that is placed within the air filter housing of a cold engine to heat the intake air and the carburetor.

2. Description of the Prior Art

In cold weather, starting an internal combustion engine sometimes requires any of various expedients such as prewarm-up of the engine, an electrical "jump" boost, ether injection into the combustion chamber or even pulling with another vehicle to crank the engine. The extra effort mentioned above, in trying to start a cold engine is the result of not being able to crank the engine fast enough or to warm-up the intake air. The use of an electrical jump start, ether or pull start can all have detrimental effects on a cold engine. Further, more and more new machines are being produced with automatic or power shift transmissions which do not allow pull starting. Electrical head bolt or water jacket heaters or other such alternatives require a source of electricity not always available when using a tractor in the field or a bulldozer on a job site.

The prior art has attempted to solve this problem using various devices for trying to heat the air about to be mixed with the fuel in the carburetor.

The Seederly U.S. Pat. No. 1,185,010, the Spal U.S. Pat. No. 2,906,848 and the Hubert U.S. Pat. No. 4,020,815 show electric heaters which heat the air going into a carburetor. However, neither of the devices in the Seederly, Spal and the Hubert patents would function satisfactorily in a dead, cold engine since the battery used as the source of electrical power to start the engine is, in all probability, too weak to provide sufficient power to the electric heater to warm the air going into the carburetor. Further each of these patents require that the devices be permanently installed in the vehicles.

The Guthre U.S. Pat. No. 2,717,305 shows an arrangement for clamping an engine heater to a car engine. First, the heating device is connected to an ordinary commercial source of power, which may not be available in the field, and second, the device does not heat the air going into the carburetor but apparently heats the block of the engine.

The Scherr U.S. Pat. No. 4,289,095 shows a preheater for an aircraft engine that supplies heated air through hot air ducts into the engine housing of an aircraft, to heat the entire engine. The device of the Scherr Patent would not be practical for a tractor or an automobile.

The Scherenberg U.S.Pat. No. 3,397,684 discloses an arrangement for preheating the combustion air of a diesel engine using a liquid-air heat exchanger for passing the combustion air through the heat exchanger. However, the arrangement of the Scherenberg Patent assumes that the electrical power source, battery, of the vehicle has sufficient power to warm the combustion air. In addition, the arrangement is permanently installed in the automobile.

The Collins U.S. Pat. No. 3,373,728 and the Majkrzak U.S. Pat. No. 4,305,354 , assigned to the same assignee as the present invention, show an arrangement wherein a second vehicle with a running engine exchanges heated cooling fluid with the dead, cold engine of the first vehicle. However, the first vehicle with the dead, cold engine is required to be adapted with proper fittings to accept the heated cooling fluid from the running engine.

Other patents, such as the Southard U.S. Pat. No. 4,309,967, the Hoffman U.S. Pat. No. 3,630.183 and the Lindsey et al U.S. Pat. No. 3,400,700 show devices having burner-type air preheaters for either heating the intake air to the engine or the cooling fluid in the cooling system. However, all of these patents require the vehicle having the dead, cold engine to have these various devices permanently installed in the vehicle.

Similarly, the Brownell U.S. Pat. No. 2,610,282 shows a device that heats cold intake air through a hot oil bath which is a permanently-installed device in the vehicle with the dead, cold engine.

The Harding U.S. Pat. No. 1,331,061 shows an arrangement that includes an electrical heating element which is attached to the air intake of the carburetor to introduce heated air into the carburetor to thoroughly vaporize the liquid fuel. The Harding Patent, as the other previously-mentioned patents, requires prior permanent installation of a heating device on the carburetor.

The Lee U.S. Pat. No. 3,394,243 shows a magnetically attachable crank case heater which uses a commercial power source. The commercial power source may not be available out in the field.

None of the above patents show an arrangement or a device that can be used out in the field to heat the intake air and the carburetor when the vehicle containing the dead, cold engine does not have its own internal heating source or is not adapted to accept an external source of heat.

SUMMARY OF THE INVENTION

The present invention provides a method and a versatile apparatus for transferring heat to the intake air and the carburetor of a dead, cold engine from a running engine of another vehicle. The method includes opening the air filter housing of the dead, cold engine and removing the air filter from the filter housing. A heating device adapted for placement within the air filter housing is placed within the air filter housing over the throat of the carburetor. The running engine supplies energy to the heating device which heats the air within the air filter housing. The heated air is then mixed by the carburetor with fuel for combustion within the engine.

The apparatus used for heating the air includes a housing which is positionable within the air filter housing of the cold engine. The housing contains a heating source such as an electric heater or a fluid-to-air heat exchanger. Suitable conduit connects the fluid-to-air heat exchanger with the cooling system of the running engine and transfers heated coolant to the heat exchanger. In the case of the electric heater, suitable electrical cable connects the electrical heating element to the electrical system of the running engine. Preferably, a fan is also included with the apparatus to blow the heated air over the carburetor.

The method and apparatus of the present invention can be used by a farmer or a construction contractor with only one vehicle equipped with the apparatus of the present invention to start any of his other vehicles without the need of the other vehicles being specially adapted to be started in cold weather.

BRIEF DESCIPTION OF THE DRAWINGS

DETAILED DESCRIPTION OF THE PREFERRED EMBODIMENT

Figure 1:
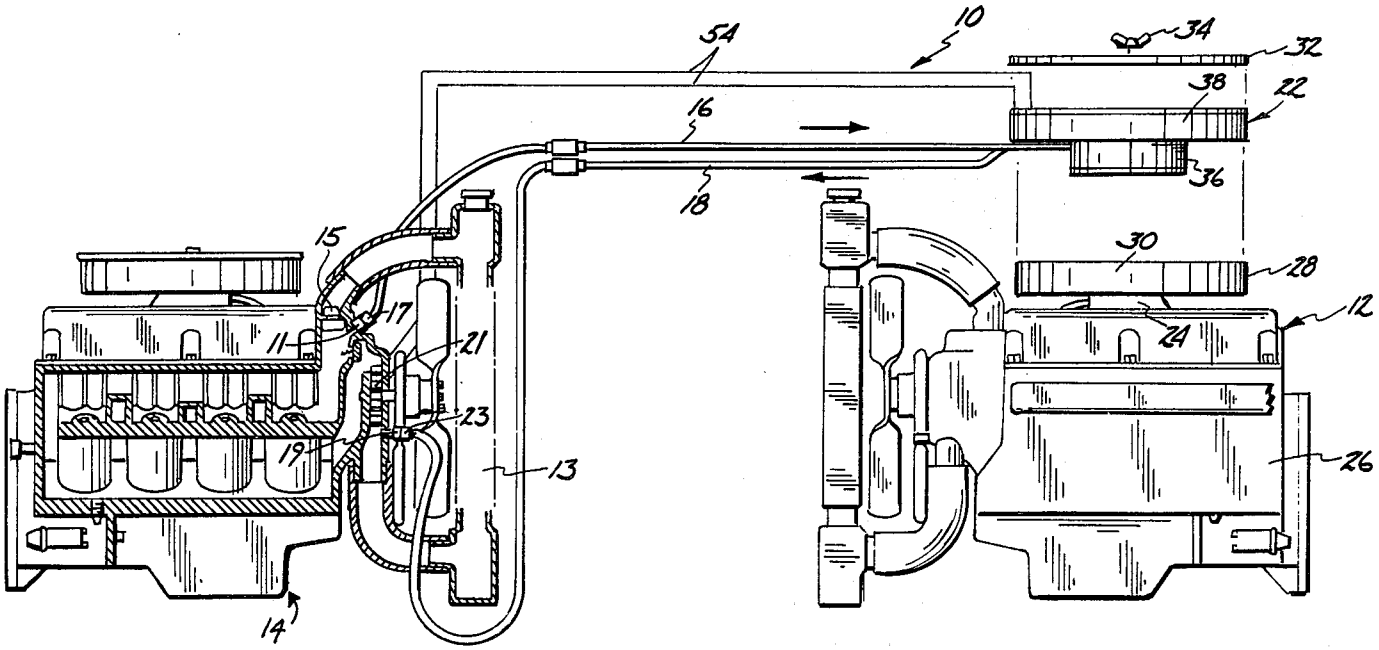
FIG. 1 is a schematic view of the present invention in operation.

FIG. 1 shows a heat transferring device of the present invention generally indicated at 10 about to be used to heat a dead, cold engine 12 of a first vehicle with a hot running engine 14 of a second vehicle.

In the embodiment shown in FIG. 1, the device 10, a supply conduit 16 and a return conduit 18 are attached at one end to the cooling system of the running engine 14. The supply conduit 16 supplies heated coolant to a fluid-to-air heat exchanger 20 (shown in FIGS. 2 and 3) within a housing 22.

The engine 14 has a first male nipple member 11 of a quick coupling attached to the engine and communicating with a cooling system 13 slightly upstream of a thermostat 15. The conduit 16 has a female end 17 for quick attachment to male nipple 11 of the conduit 16 to the cooling system 13 for supplying heated coolant. A second male nipple member 19 is attached to an intake of a water pump 21. The conduit 18 also has a female end 23 for quick attachment of conduit 18 to the cooling system 13 for returning coolant. A similar connection to a running engine is illustrated in the Majkrzak U.S. Pat. No. 4,305,354.

The dead, cold engine 12 is an internal combustion engine, requiring an air and fuel mixture for combustion. A carburetor 24 is situated on top of an engine block of the engine 12 and provides an explosive mixture of fuel and air to the engine. A conventional air cleaner 28 is positioned on the throat of the carburetor to filter the air that is mixed by the carburetor with the fuel. The air cleaner contains a filter housing 30, an air filter (not shown) and a cover 32 which is normally positioned on the air filter housing 30 and secured thereto by a mechanical fastener such as nut 34 which threads onto a screw (not shown) extending upwardly through the air filter and an aperture in cover 32.

Figure 2:
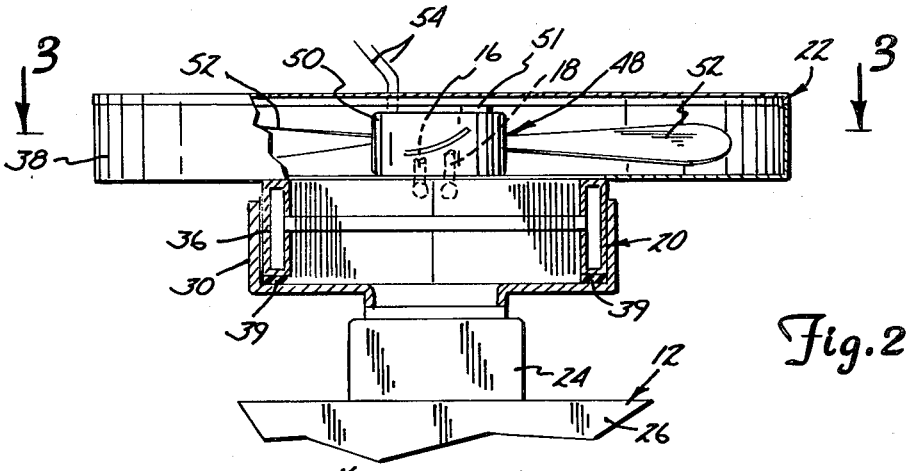
FIG. 2 is a partial cross sectional view of a heating apparatus within the air cleaner housing of the cold engine.

Referring to FIG. 2, the housing 22 of the apparatus of the present invention includes a first smaller diameter section 36 and a second larger diameter section 38. The smaller diameter section 36 is configured to fit within smaller diameter filter housings while the larger diameter section 38 is configured to fit within larger diameter filter housings. The smaller diameter section has a preferred diameter that is slightly larger than the throat of the typical carburetor. Therefore, the smaller section 36 can also be placed within larger filter housings that contain devices that protrude from the floor of the housing and prevent the larger section from sitting flat on the floor of the housing 30.

Figure 3:
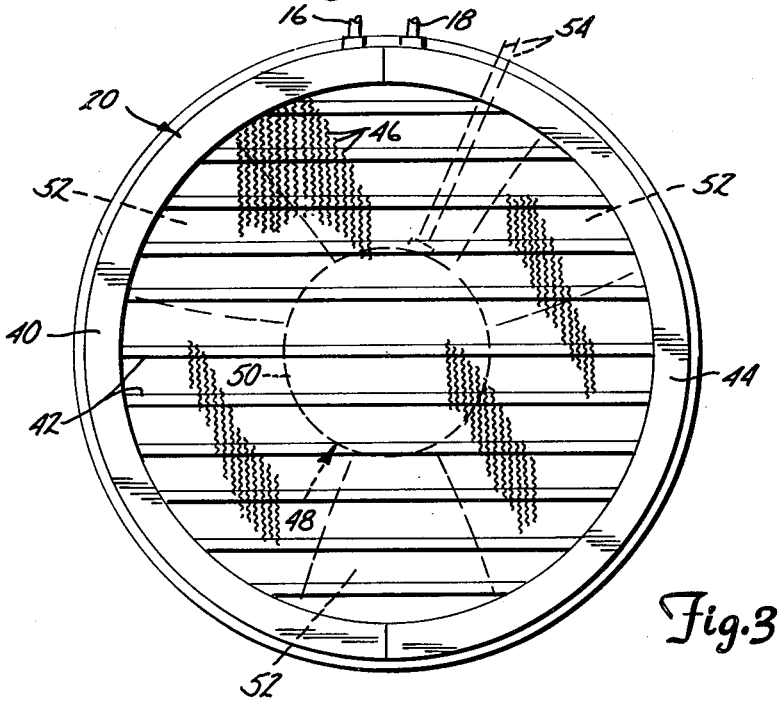
FIG. 3 is a cross sectional view of the heating apparatus of the present invention taken along line 3—3 in FIG. 2.

After the filter (not shown) and the cover 32 are removed, the device 10 with the fluid-to-air heat exchanger 20 is positioned within the filter housing as illustrated in both FIGS. 2 and 3. The fluid-to-air heat exchanger includes a first supply manifold 40 wherein the heated coolant enters from supply conduit 16 and flows through the first manifold 40 and into a plurality of tubes 42. A second return manifold 44 communicates with the tubes 42 at another end for delivering the coolant through conduit 18 back to the running engine 14. Heat is transferred from the coolant through the tubes 42 to a plurality of fins 46. Although the fin tube heat exchanger 20 as shown in FIGS. 2 and 3 is positioned within the smaller section 36, it should be understood that the heat exchanger may be positioned in either the larger section 38 or the smaller section 36. In addition, other fluid-to-air heat exchanger configurations are within the scope of the present invention.

As illustrated in FIG. 2, the height of the smaller section is greater than the height of the vertical walls of the filter housing. Similarly, the height of the larger section 38 is greater than the height of the vertical walls of the filter housing. The supply and return conduits are positioned proximate the connection of the smaller section 36 and the larger section 38. With the height of both the smaller section 36 and the larger section 38 being greater than the walls of the filter housing 30 and the conduits 16 and 18 connected to the exchanger 20 proximate the connection of sections 36 and 38, the device 10 can be flipped over and set flatly against the floor of the filter housing without interference between the conduits 16 and 18 and the filter housing wall.

A felt pad 39 extends in a circular manner along the bottom of smaller section 36. The felt pad 39 conforms to any surface irregularities found on the floor of the housing and provides an air seal between the device 10 and the floor of the housing. Although not shown, a felt pad can also be positioned on the larger section 38 in a similar manner.

In a preferred embodiment, the apparatus of the present invention contains an air circulating fan 48 having a motor 50 and fan blades 52. The fan 48 is powered by the running engine through suitable electrical wires 54 connected to the electrical system of the running engine 14. The fan 48 increases the heat transfer efficiency of the heat exchanger 20 and provides positive air pressure on the carburetor 24 decreasing the time needed to warm up the carburetor. The fan motor 50 is preferably a reversing motor controlled by a switch 51 that reverses the direction of the motor and the direction of rotation of the fan blades. The direction of rotation of the fan blades is reversed to blow air over the carburetor when the device 10 is flipped over.

Figure 4:
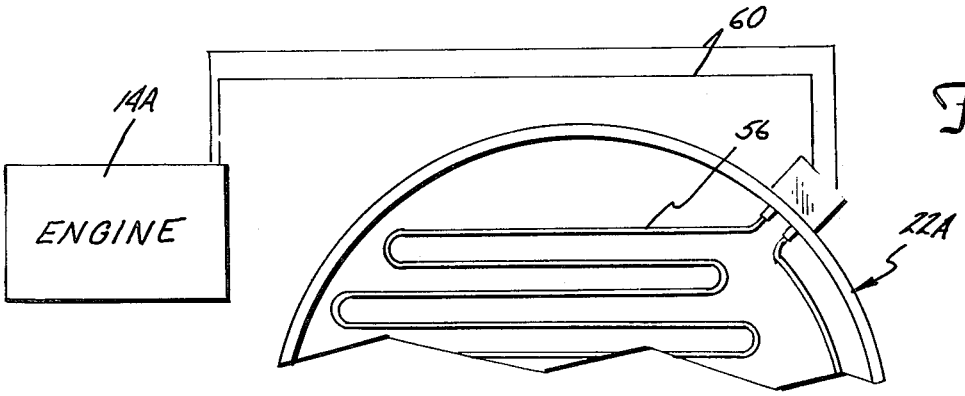
FIG. 4 is a schematic view of another embodiment of the present invention using an electric heating element.

Another embodiment of the present invention using an electrical heating element is illustrated in FIG. 4. The embodiment in FIG. 4 is similar to the embodiment shown in FIGS. 2 and 3 and described above, with the exception that an electrical heating element 56 is contained within the housing **22*a* instead of the fluid-to-air heat exchanger 20. The electrical heating element 56 similarly heats the air over the carburetor and can be included within either the smaller section 36 or the larger section 38 of the housing. Further, the fan 48 can also be used to force air over the heating elements, increasing the heat transfer efficiency of the electrical heating element and decreasing the time for heating the carburetor 24**.

The heating element 56 is electrically connected to the electrical system of the running engine 14*a*, as illustrated in FIG. 4, preferably by suitable electrical wires 60 extending to suitable terminals (not shown) energized by the vehicle's alternator.

In operation, whether using the apparatus of the present invention having the fluid-to-air heat exchanger or the electrical heating element, the procedure is the same. First, the cover 32 of the air cleaner must be removed along with the filter element within the air filter housing. Next, depending on the size of the air cleaner, either the smaller section 36 or the larger section 38 is placed within the air filter housing. When a smaller air filter housing is contained on the engine or when there are protrusions from the floor of the housing, the smaller section 36 is used. However, when a larger air filter housing is encountered, the housing 22 is merely flipped over and the larger section 38 is placed within the filter housing. The switch 51 is used to reverse the rotation of the fan blades so that the fan blows air onto the carburetor.

In either case, whether the fluid-to-air heat exchanger is used or the electrical heater, the running engine supplies energy to the apparatus of the present for heating the air being supplied to a carburetor of a dead, cold engine. The dead, cold engine need not be specially adapted for supplying heater energy to assist in starting the engine in cold weather. The method and apparatus of the present invention allows a farmer or a contractor to equip only one vehicle but still be able to provide heat to all his other vehicles in starting them in cold weather.

Although the present invention has been described with reference to preferred embodiments, workers skilled in the art will recognize that changes may be made in form and detail without departing from the spirit and scope of the invention.

What is claimed:

1. A method for heating a first cold internal combustion engine having an air filter in an air filter housing positioned over a throat of a carburetor with a second internal combustion engine providing energy to a heat transferring device for heating air proximate the carburetor of the cold engine, the method comprising:

opening the air filter housing of the first cold engine;

removing the air filter from the air filter housing positioning the heat transferring device within the air filter housing; and supplying energy to the heat transferring device to heat the air proximate the carburetor.

2. The method of claim 1 and further including:

conveying air over the heat transferring device and into the throat of the carburetor.

3. The method of claim 1 wherein the energy supplied to the heat transferring device is a heated coolant from a cooling system of the running engine.

4. The method of claim 1 wherein the energy supplied to the heat transferring device is electrical energy from an electrical system from the running engine.

5. An apparatus for heating a first cold internal combustion engine of a first vehicle with a second vehicle having a second internal combustion engine, the first cold engine having an air filter housing positioned over a carburetor, the apparatus comprising:

an apparatus housing positionable within the air filter housing of the cold engine;

means for transferring heat to air near the carburetor mounted within the housing; and means for supplying energy from the running engine to the means for transferring heat attached to the means for transferring heat such that energy is supplied to the means for transferring heat.

6. The apparatus of claim 5 and further including:

fan means for conveying air through the means for transferring heat mounted within said housing to increase the heat transfer efficiency of the means for transferring heat and provide positive warm air pressure over the carburetor.

7. The apparatus of claim 5 wherein the means for transferring heat includes a fluid to air heat exchanger positioned within the apparatus housing and wherein the means for supplying energy includes a supply and return conduit for supplying heated coolant from a running engine having a cooling system and for returning the coolant to the running engine.

8. The apparatus of claim 5 wherein the means for transferring heat is an electrical heating element and wherein the means for supplying energy includes electrical conduit electrically connected to an electrical system of a running engine.

9. The apparatus of claim 5 wherein the housing includes a first housing section and a second housing section larger in diameter than the first housing section with the first housing section being slightly larger in diameter than the throat of the carburetor.

10. The apparatus of claim 9 wherein the means for supplying energy from the running engine to the means for transferring heat is positioned along a plane where the first housing section and the second housing section meet and the first housing section and the second housing section being greater in height than a wall of a filter housing so that either the first housing section or the second housing section may be fitted within an air filter housing without the means for supplying energy interfering with the walls of the filter housing.

11. The apparatus of claim 10 and further including:

fan means for conveying air through the means for transferring heat to increase the heat transfer efficiency of the means for transferring heat and provided position warm air pressure over the carburetor and including a switch for reversing the rotation of the fan means.

* * * * *